US006648986B1

(12) United States Patent
Tang et al.

(10) Patent No.: US 6,648,986 B1
(45) Date of Patent: Nov. 18, 2003

(54) STABILITY ADDITIVE FOR TRIVALENT CHROME CONVERSION COATING BATH SOLUTIONS

(75) Inventors: Xia Tang, W. Hartford, CT (US); Promila Bhatia, Bristol, CT (US); Joseph John Parkos, Jr., East Haddam, CT (US); Gary M. Lomasney, Glastonbury, CT (US); Mark Jaworowski, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/146,435

(22) Filed: May 13, 2002

(51) Int. Cl.[7] ..... C23C 22/00

(52) U.S. Cl. ..... 148/267; 106/14.11; 106/14.13; 106/14.15; 106/14.44; 148/243; 428/469; 428/472

(58) Field of Search ..... 106/14.11, 14.13, 106/14.15, 14.44; 148/243, 267; 428/469, 472

(56) References Cited

U.S. PATENT DOCUMENTS

| | | | | | |
|---|---|---|---|---|---|
| 3,501,352 | A | * | 3/1970 | Shah | 428/472.1 |
| 3,725,214 | A | * | 4/1973 | Bride | 205/120 |
| 4,107,004 | A | * | 8/1978 | Ward et al. | 205/286 |
| 4,171,231 | A | | 10/1979 | Bishop et al. | 148/267 |
| 4,263,059 | A | * | 4/1981 | Guhde et al. | 428/472.1 |
| 4,384,902 | A | * | 5/1983 | Crotty et al. | 148/266 |
| 5,304,257 | A | | 4/1994 | Pearlstein et al. | 148/265 |
| 5,374,347 | A | | 12/1994 | Pearlstein et al. | 148/276 |

FOREIGN PATENT DOCUMENTS

WO WO 02/20874 A2 * 3/2002

* cited by examiner

*Primary Examiner*—Anthony J. Green
(74) *Attorney, Agent, or Firm*—Bachman & LaPointe, P.C.

(57) ABSTRACT

An acidic aqueous solution containing a water soluble trivalent chromium compound is provided with a solution stability additive for reducing precipitation of trivalent chromium over time. The concentration of the solution stability additive varies based on the complexing capability of the additive. Suitable additives for use as solution stability additives in accordance with the present invention are selected from the group consisting of acetic acid, glycolic acid, and mixtures thereof.

21 Claims, No Drawings

STABILITY ADDITIVE FOR TRIVALENT CHROME CONVERSION COATING BATH SOLUTIONS

BACKGROUND OF THE INVENTION

The present invention relates to a process for preparing a corrosion-resistant trivalent chromium coating on a metal, preferably aluminum and aluminum alloys, and an improved acidic aqueous solution for use in the process.

Conversion coatings have been widely used in metal surface treatment for improved corrosion inhibition and improved adhesion of a subsequently applied paint layer. Conversion coatings are applied through chemical reactions between the metal and the bath solution which converts or modifies the metal surface into a thin film with required functional properties. Conversion coatings are particularly useful in surface treatment of metals such a steel, zinc, aluminum and magnesium. In the past, chromate conversion coatings have proven to be the most successful conversion coatings for aluminum and magnesium. However, chromate conversion coatings used in the past generally contained highly toxic hexavalent chromium. The use of hexavalent chromium results in potential hazardous working conditions for process operators and very high costs for waste disposal.

In order to overcome the problems associated with hexavalent chromium containing conversion coatings, there has been an effort to employ trivalent chromium conversion coatings which are far more acceptable from an environmental standpoint. U.S. Pat. Nos. 4,171,231, 5,304,257 and 5,374,347 disclose trivalent chromium solutions for use in forming conversion coatings on metals. One drawback of these trivalent chromium processes and acidic aqueous solutions is the formation of chromium containing precipitate in the processing bath solution over time. The precipitation results in material loss in the solution and affects coating quality when the concentrations of key components drop below desired and required levels.

Accordingly, it is the principal object of the present invention to provide a more stable solution by adding complexing agents that can form soluble complexes with trivalent chromium in solution and thereby prevent the solution from precipitation.

SUMMARY OF THE INVENTION

In accordance with the present invention the foregoing object is readily obtained.

In accordance with the present invention, an acidic aqueous solution containing a water soluble trivalent chromium compound is provided with a solution stability additive for reducing precipitation of trivalent chromium over time. The solution stability additive comprises a complexing agent selected from the group consisting of organic acids (single coordination acids and bidentate chelating compounds) and amino acids. The concentration of the solution stability additive varies based on the complexing capability of the additive. Suitable additives for use as solution stability additives in accordance with the present invention are selected from the group consisting of acetic acid, glycolic acid, and mixtures thereof.

For the features of the present invention will be made clear from the following detailed description.

DETAILED DESCRIPTION

The present invention relates to a process for preparing a corrosion-resistant trivalent chromium coating on a metal, preferably aluminum and aluminum alloys, and an improved acidic aqueous solution for use in the process.

The process for preparing a corrosion-resistant trivalent chromium coating on aluminum and aluminum alloy substrates comprises treating the substrates with an acidic aqueous solution, which is free of hexavalent chromium, comprising a water soluble trivalent chromium compound, a water soluble fluoride compound, an alkaline pH adjustment reagent and a solution stability additive for reducing the precipitation of trivalent chromium. In accordance with the present invention, the solution stability additive comprises a complexing agent selected from the group consisting of organic acids and amino acids. Generally, the solution stability additive is present in an amount of between $1\times10^{-4}$ moles/liter (M/l) and $1\times10^{-2}$ M/l with respect to the total acid solution, preferably between $1\times10^{-3}$ M/l and $8\times10^{-3}$ M/l with respect to the total acidic aqueous solution. Particularly suitable additives for use as a solution stability additive are selected from the group consisting of acetic acid, glycolic acid, and mixtures thereof.

The acidic aqueous solution to which the solution stability additive is introduced comprises a water soluble trivalent chromium compound, a water soluble fluoride compound and an alkaline reagent. The trivalent chromium compound is present in the solution in an amount of between 0.2 g/liter to 5 g/liter (preferably between 0.5 g/liter to 2 g/liter), the fluoride compound is present in an amount of between 0.2 g/liter to 5 g/liter (preferably 0.5 g/liter to 2 g/liter), and the alkaline reagent is present in an amount to maintain the pH of the solution between 3.0 to 5.0 (preferably 3.5 to 4.0).

By providing the solutions stability additive in the amount of $1\times10^{-4}$ M/l to $1\times10^{-2}$ M/l, (preferably $1\times10^{-3}$ M/l to $8\times10^{-3}$ M/l), it has been found that precipitation of trivalent chromium over time is reduced as evidence by the following example.

EXAMPLE

Three bath solutions were prepared having the following compositions:

Solution 1: 1.59 g/L $Cr_4(SO_4)_5(OH)_2$ and 1.56 g/L $K_2ZrF_6$

Solution 2: 4.2 mM acetic acid, 1.59 g/L $Cr_4(SO_4)_5(OH)_2$ and 1.56 g/L $K_2ZrF_6$ Solution 3: 4.2 mM glycolic acid, 1.59 g/L $Cr_4(SO_4)_5(OH)_2$ and 1.56 g/L $K_2ZrF_6$ The solutions were prepared according to the following procedures:

$Cr_4(SO_4)_5(OH)_2$ stock solution (Part A) was prepared by adding 15.9 g of $Cr_4(SO_4)_5(OH)_2$, purchased from Fluka (Milwaukee, Wis.), in 1 liter of distilled dionized (DI) water. 18.24 mL of 0.5N NaOH solution was added to $Cr_4(SO_4)_5(OH)_2$ stock solution to adjust pH. This stock solution was then allowed to equilibrate for more than 12 hours at room temperature until pH reached 3.25–3.4. $K_2ZrF_6$ stock solution (Part B) was prepared by dissolving 15.6 g of $K_2ZrF_6$, purchased from Aldrich (Milwaukee, Wis.,) to 1 liter of DI water and then filtered to remove undissolved solid. Acetic acid stock solution was prepared by adding 2.7 mL glacial acetic acid (99.8%) in 100 mL DI water. Glycolic acid stock solution was prepared by dissolving 0.637 g of glycolic acid in 100 mL DI water. The bath solutions were made according to the compositions listed in Table I. The pH of all bath solutions are controlled in the range of 3.5–4.0.

TABLE I

Compositions of coating bath solutions

| Solution ID | Part A (mL) | Part B (mL) | DI water (mL) | Acetic acid stock solution (mL) | Glycolic acid stock solution (mL) | 0.5N NaOH (mL) |
|---|---|---|---|---|---|---|
| Solution 1 | 100 | 100 | 800 | — | — | — |
| Solution 2 | 200 | 200 | 1600 | 20 | — | — |
| Solution 3 | 200 | 200 | 1500 | — | 100 | 9 |

All the solutions were aged for more than 24 hours before processing any panels. Two 4"×3.3" Al 2024 panels were coated in 1 liter of Solution 1 and four 3"×5" Al 2024 panels were processed in two liters of Solution 2, 3 respectively. The coatings were prepared according to the following procedures:

1) For Solution 2, 3 the coupons were mechanically abraded using Scotch Brite on both sides of the coupons, and then cleaned with 2-propanol and dried with paper towels before coating in bath solutions. For Solution 1, the coupons were first cleaned in light duty alkaline cleaner (Enprep™ 35, Enthone, Inc.) for 7 min at 120–150° F., with stirring before mechanically abraded using Scotch Brite. The coupons were then rinsed with distilled water.
2) The coupons were immersed in bath solution for 10 min at room temperature.
3) The coupons were rinsed with DI water and air dry for more than 24 hours.

The bath solution without stability additive produced a thin green-blue coating. The solutions containing acetic acid and glycolic acid additives produced thin blue-violet conversion coatings. After first batch processing, the solutions were then allowed to age at room temperature.

Precipitate was observed in (Solution 1) within 24 hours after the coating process. No precipitate was observed after 24 hours in the solutions containing acetic acid and glycolic acid. Only a small amount of precipitate formed in the solution containing acetic acid after 10 days. No precipitate formed in the bath solution containing glycolic acid after more than 30 days.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An acidic aqueous solution which is free of hexavalent chromium comprises a water soluble trivalent chromium compound, a water soluble fluoride compound, an alkaline reagent, and a solution stability additive for reducing the precipitation of trivalent chromium over time, wherein the solution stability additive is present in an amount of between $1\times10^{-4}$ M/l to $1\times10^{-2}$ M/l with respect to the total acidic aqueous solution.

2. An acidic aqueous solution according to claim 1 wherein the solution stability additive is present in an amount of between $1\times10^{-3}$ M/l to $8\times10^{-3}$ M/l with respect to the total acidic aqueous solution.

3. An acidic aqueous solution according to claim 1 wherein the trivalent chromium compound is present in the solution in an amount of between 0.2 g/liter to 5 g/liter, the fluoride compound is present in an amount of between 0.2 g/liter to 5 g/liter, and the alkaline reagent is present in an amount to maintain the pH of the solution between 3.0 to 5.0.

4. An acidic aqueous solution according to claim 1 wherein the trivalent chromium compound is present in the solution in an amount of between 0.5 g/liter to 2 g/liter, the fluoride compound is present in an amount of between 0.5 g/liter to 2 g/liter, and the alkaline reagent is present in an amount to maintain the pH of the solution between 3.5 to 4.0.

5. An acidic aqueous solution which is free of hexavalent chromium comprises a water soluble trivalent chromium compound, wherein the trivalent chromium compound is present in the solution in an amount of between 0.2 g/liter to 5 g/liter, the fluoride compound is present in an amount of between 0.2 g/liter to 5 g/liter, and the alkaline reagent is present in an amount to maintain the pH of the solution between 3.0 to 5.0 a water soluble fluoride compound, an alkaline reagent, and a solution stability additive for reducing the precipitation of trivalent chromium over time.

6. An acidic aqueous solution according to claim 5 wherein the solution stability additive is present in an amount of between $1\times10^{-4}$ M/l to $1\times10^{-2}$ M/l with respect to the total acidic aqueous solution.

7. An acidic aqueous solution according to claim 5 wherein the solution stability additive is present in an amount of between $1\times10^{-3}$ M/l to $8\times10^{-3}$ M/l with respect to the total acidic aqueous solution.

8. An acidic aqueous solution according to claim 5 wherein the trivalent chromium compound is present in the solution in an amount of between 0.5 g/liter to 2 g/liter, the fluoride compound is present in an amount of between 0.5 g/liter to 2 g/liter, and the alkaline reagent is present in an amount to maintain the pH of the solution between 3.5 to 4.0.

9. An acidic aqueous solution according claim 1 or claim 5 wherein the solution stability additive is selected from the group consisting of organic acids and amino acids.

10. An acidic aqueous solution according to claim 9 wherein the solution stability additive is selected from the group consisting of acetic acid, glycolic acid, and mixtures thereof.

11. A process for preparing a corrosion-resistant trivalent chromium coating on aluminum and aluminum alloy substrates comprises treating the substrates non-electrolytically with an acidic aqueous solution, which is free of hexavalent chromium, comprising a water soluble trivalent chromium compound, a water soluble fluoride compound, an alkaline reagent, and a solution stability additive for reducing the precipitation of trivalent chrome precipitates over time.

12. A process according to claim 11 wherein the solution stability additive is selected from the group consisting of acetic acid, glycolic acid, and mixtures thereof.

13. A process according to claim 12 wherein the solution stability additive is present in an amount of between $1\times10^{-4}$ M/l to $1\times10^{-2}$ M/l with respect to the total acidic aqueous solution.

14. A process according to claim 12 wherein the solution stability additive is present in an amount of between $1\times10^{-3}$ M/l to $8\times10^{-3}$M/l with respect to the total acidic aqueous solution.

15. A process according to claim 13 wherein the trivalent chromium compound is present in the solution in an amount of between 0.2 g/liter to 5 g/liter, the fluoride compound is present in an amount of between 0.2 g/liter to 5 g/liter, and the alkaline reagent is present in an amount to maintain the pH of the solution between 3.0 to 5.0.

16. A process according to claim 14 wherein the trivalent chromium compound is present in the solution in an amount of between 0.5 g/liter to 2 g/liter, the fluoride compound is present in an amount of between 0.5 g/liter to 2 g/liter, and the alkaline reagent is present in an amount to maintain the pH of the solution between 3.5 to 4.0.

17. A process according to claim 11, including immersing the substrates in the aqueous solution.

18. A process according to claim 17, including maintaining the pH of the aqueous solution between 3.0 to 5.0.

19. A process according to claim 17, including maintaining the pH of the aqueous solution between 3.5 to 4.0.

20. An article comprising a metal substrate and a trivalent containing conversion coating on the metal substrate, the trivalent containing conversion coating being prepared in accordance with the process of any one of claims 11–19.

21. An article according to claim 20 wherein the metal is aluminum.

* * * * *